US011739758B2

(12) United States Patent
Forsberg et al.

(10) Patent No.: US 11,739,758 B2
(45) Date of Patent: Aug. 29, 2023

(54) MOTOR LEAD STANDOFF ELEMENTS FOR SUBMERSIBLE WELL PUMP

(71) Applicant: Baker Hughes Oilfield Operations LLC, Houston, TX (US)

(72) Inventors: Michael Forsberg, Claremore, OK (US); Leslie C. Reid, Coweta, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 0 days.

(21) Appl. No.: 17/037,576

(22) Filed: Sep. 29, 2020

(65) Prior Publication Data

US 2021/0095673 A1 Apr. 1, 2021

Related U.S. Application Data

(60) Provisional application No. 62/908,686, filed on Oct. 1, 2019.

(51) Int. Cl.

| | |
|---|---|
| ***F04D 13/08*** | (2006.01) |
| ***F04D 29/40*** | (2006.01) |
| ***F04B 47/00*** | (2006.01) |
| ***F04D 13/06*** | (2006.01) |

(52) U.S. Cl.

CPC ..... *F04D 13/08* (2013.01); *F04B 47/00* (2013.01); *F04D 13/0693* (2013.01); *F04D 29/406* (2013.01)

(58) Field of Classification Search

CPC ..... F04D 13/08; F04D 13/083; F04D 13/086; F04D 13/0693; F04D 25/0686; F04D 25/0693; F04D 29/406; E21B 17/1035; F04B 47/00

USPC ..... 417/410.1, 414, 423.1, 423.3; 166/66.4

See application file for complete search history.

(56) References Cited

U.S. PATENT DOCUMENTS 5,255,739 A * 10/1993 Neuroth ..... E21B 17/1035 166/65.1
5,343,942 A * 9/1994 Del Serra ..... E21B 17/1035 166/241.7
5,379,836 A * 1/1995 Jordan ..... E21B 17/1035 166/241.6

(Continued)

FOREIGN PATENT DOCUMENTS

EP 0886032 A2 12/1998
WO WO-2016036280 A1 * 3/2016 ..... F04D 13/10

OTHER PUBLICATIONS

International Search Report and Written Opinion of PCT Application No. PCT/US2020/053872 dated Jan. 20, 2021 pp. 1-10.

*Primary Examiner* — Charles G Freay
*Assistant Examiner* — Chirag Jariwala
(74) *Attorney, Agent, or Firm* — Bracewell LLP; Keith R. Derrington

(57) ABSTRACT

An electrical submersible pump assembly has a motor lead extending alongside the pump housing to the motor for supplying electrical power to the motor. At least one standoff wedges between the pump housing and the motor lead. The standoff has a channel in which the motor lead is received. The standoff has legs extending inward from the channel into contact with the pump housing. The legs space the channel of the standoff from the pump housing by a gap to enable well fluid flow between the motor lead and the pump housing.

19 Claims, 2 Drawing Sheets

(56) References Cited

U.S. PATENT DOCUMENTS

| | | | | |
|---|---|---|---|---|
| 5,553,666 | A * | 9/1996 | Hartman | E21B 17/1035 166/62 |
| 6,023,027 | A * | 2/2000 | Neff | E21B 17/1035 138/110 |
| 9,752,392 | B2 | 9/2017 | Semple et al. | |
| 9,958,104 | B2 | 4/2018 | Baker et al. | |
| 9,988,893 | B2 | 6/2018 | McCoy | |
| 2010/0147505 | A1* | 6/2010 | Manke | F04B 47/06 166/66.4 |
| 2010/0243272 | A1* | 9/2010 | Coronado | E21B 17/1035 166/380 |
| 2015/0184790 | A1* | 7/2015 | Baker et al. | F16L 59/12 137/377 |
| 2015/0337605 | A1 | 11/2015 | Longbottom | |
| 2016/0069141 | A1* | 3/2016 | Blackmon | E21B 19/00 166/380 |
| 2018/0094492 | A1* | 4/2018 | Knapp | E21B 17/023 |

* cited by examiner

MOTOR LEAD STANDOFF ELEMENTS FOR SUBMERSIBLE WELL PUMP

CROSS REFERENCE TO RELATED APPLICATION

This application claims priority to provisional application Ser. No. 62/908,686 filed Oct. 1, 2019.

FIELD OF THE DISCLOSURE

This disclosure relates in general to submersible well pump assemblies and in particular to standoffs for providing a fluid flow gap between the motor lead and the pump housing.

BACKGROUND

Electrical submersible pumps (ESP) are employed in many oil wells to pump well fluid from the well. A typical ESP has an electrical motor coupled to the pump for driving the pump. A seal section or pressure equalizer connects to the motor for equalizing a pressure of dielectric lubricant inside with the well fluid pressure on the exterior. Usually, the pressure equalizer locates between the motor and pump. The ESP may also have a gas separator connected to a lower end of the pump. A string of production tubing usually supports the ESP within the well. An electrical power cable extends downward alongside the tubing from a wellhead assembly. A lower portion of the power cable, referred to as a motor lead, extends alongside the pump, gas separator, if employed, and pressure equalizer to a connector at the upper end of the motor.

The motor lead normally comprises a cable with three electrical power wires side by side in a flat configuration. Each electrical power wire includes a copper core or conductor with one or more layers of electrical insulation. A lead sheath may be extruded around the electrical insulation to provide protection in gassy wells. An outer armor band wraps helically around the sub assembly of electrical power wires.

In some wells, the pump can become hot enough to cause damage to the motor lead. Typically, the heat occurs as a result a lack of well fluid flowing through the pump due to gas locking or pump-off conditions. The excess heat in the pump, as well as any excess heat in the pressure equalizer and/or gas separator, may transfer to the motor lead. The excess heat is particularly a problem with motor leads having lead sheaths. Excessive heat causes the lead sheaths to soften and change shape, becoming thinner. If too thin, the lead sheaths may not be able to provide the desired protection to the electrical conductor insulation layers.

U.S. Pat. No. 9,958,104 discloses a thermal insulation layer to retard heat transfer to the motor lead. The thermal insulation layer is located between the motor lead and the exterior of the pump housing.

SUMMARY

An electrical submersible pump assembly for pumping well fluid from a well, comprises a pump having a tubular pump housing with a longitudinal axis. A motor operatively connects to the pump for driving the pump. A motor lead extends alongside the pump housing to the motor for supplying electrical power to the motor. At least one standoff wedges between the pump housing and the motor lead, the standoff having a channel in which the motor lead is received. The standoff has at least one leg extending inward from the channel relative to the axis into contact with the pump housing. The leg spaces the channel of the standoff from the pump housing by a gap to enable well fluid flow between the motor lead and the pump housing.

In the embodiment shown, the standoff has four legs. More particularly, the standoff has a base and a pair of side walls extending outward from opposite edges of the base. The legs extend inward from the base.

In the embodiment shown, each sidewall extends outward relative to the axis from an opposite edge of the base. Each of the side walls has an outer edge spaced outward from the base. A plurality of lugs extend outward from the outer edge of each of the side walls. A distance from the base to an outer edge of each of the lugs is greater than a radial dimension of the motor lead.

A metallic band secures around the pump housing and over the channel of at least one of the standoffs, retaining the motor lead within the channel of the standoffs. In another one of the standoffs, the motor lead biases the leg against the pump housing. In the embodiment shown, the assembly has an upper standoff, an intermediate standoff and a lower standoff spaced axially apart from each other. Metallic bands clamp the upper and lower standoffs to the pump housing. The motor lead wedges the legs of the intermediate standoff against the housing and a metallic band is not required.

BRIEF DESCRIPTION OF THE DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF THE DISCLOSURE

Figure 1A:
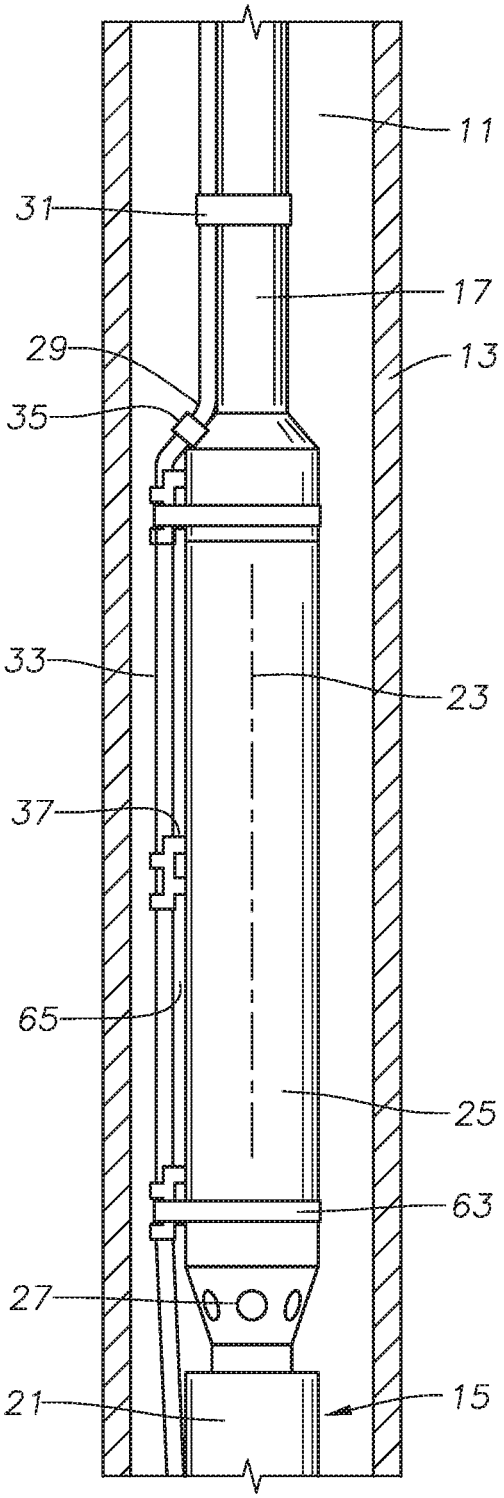
FIGS. 1A and 1B comprise a side view of an electrical submersible pump assembly having motor lead standoffs in accordance with this disclosure and installed in a well.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1B:
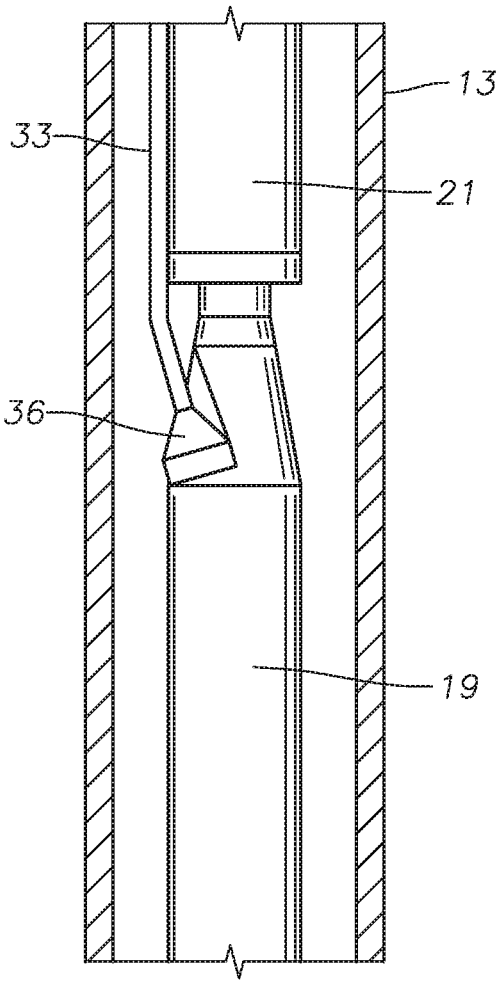

Referring to FIGS. 1A and 1B, a well 11 has casing 13 that is perforated or has openings to admit well fluid. The figures show a pump assembly 15 supported on production tubing 17 extending into well 11. Although shown installed vertically, pump assembly 15 could be located within an inclined or horizontal section of well 11. Pump assembly 15 has several modules, including a motor 19, normally a three-phase electrical motor. In this example, a motor lubricant equalizer or seal section 21 connects to the upper end of motor 19 and has flexible components, such as a bladder, for reducing a pressure differential between lubricant in motor 19 and the hydrostatic pressure of well fluid. Alternately, the pressure equalizing components could be secured to a lower end of motor 19. An optional gas separator (not shown) may connect to seal section 21. Pump assembly 15 has a longitudinal axis 23.

A pump 25 connects to the upper end of seal section 21. Pump 25 has a well fluid intake 27 at the lower end of pump 25. Pump 25 is normally a rotary pump, such as a centrifugal or progressing cavity pump. Pump 25 could comprise several pumps connected in tandem. The connections between the modules of pump assembly 15 are normally bolted flanges, but they could be threaded connections.

A power cable 29 extends from a wellhead (not shown) alongside tubing 17 for supplying power to motor 19. Spaced apart production tubing bands or clamps 31 (only one shown) are crimped around production tubing 17 and power cable 29 to secure power cable 29 to production tubing 17. A motor lead 33 connects to a lower end of power cable 29 by a splice 35. Motor lead 33 extends alongside pump assembly 15 and has an electrical connector on its lower end that secures to a receptacle at the upper end of motor 19. Splice 35 is illustrated at the upper end of pump 25, but it could be a considerable distance above pump 25. Motor lead 33 often has a length from 80 to 90 feet.

A plurality of standoffs 37 are spaced axially apart from each other along the length of pump 25 between pump 25 and motor lead 33. One standoff 37 is illustrated near the upper end of pump 25, one near the lower end, and a third in the middle. More or fewer standoffs 37 and different locations are feasible. As an example, standoffs 37 could be spaced apart from each other 2 to 10 feet. Also, if desired, standoffs 37 could be located between motor lead 33 and seal section 21. Each standoff 37 pushes motor lead 33 radially out from the exterior of pump 25, relative to axis 23, preventing physical contact between the exterior of pump 25 and motor lead 33. The space provided between motor lead 33 and the exterior of pump 25 facilitates the circulation of well fluid between motor lead 33 and pump 25 as the well fluid flows toward intake 27.

Figure 3:
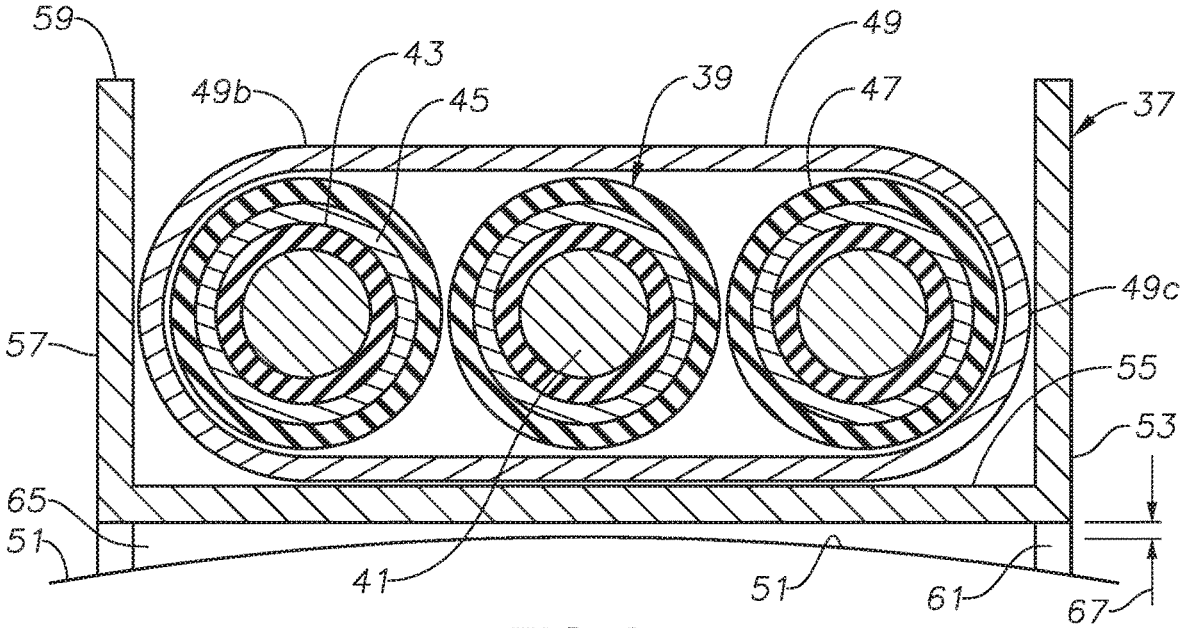
FIG. 3 is a sectional view of the standoff of FIG. 2, taken along the line 3-3 of FIG. 2.

As shown in FIG. 3, motor lead 33 has electrical wires or insulated conductors 39, normally three, which are oriented side-by-side in this example. A single plane passes through the center line of each insulated conductor 39, thus this type of motor lead 33 is considered to have a flat configuration. Each insulated conductor 39 has a copper wire or core 41 with a separate electrical insulation layer 43 surrounding each core 41. Insulation layer 43 may be of any conventional material used for insulating conductor cores 41 in submersible pump motor leads, such as an ethylene propylene diene monomer (EPDM). A separate lead sheath 45 optionally encases each insulation layer 43. Lead sheath 45 is impervious to chemical or gas migration. Lead sheath 45 also reduces decompression when retrieving pump assembly 15 and is particularly used for wells that have hot and gassy conditions. A bedding tape 47 may be wrapped separately around each lead sheath 45 for mechanical protection. An armor 49 wraps around the assembled three insulated and sheathed conductors 39. Armor 49 comprises a steel band wrapped helically around the assembled conductors 39. Armor 49 has a flat inward-facing side 49*a*, a flat outward-facing side 49*b*, and curved or rounded side edges 49*c* joining the inward and outward-facing sides 49*a*, 49*b*.

In some wells, pump 25 can become hot enough to cause damage to motor lead 33. Typically, the heat occurs due to a lack of well fluid flowing through pump 25 because of gas locking or pump-off conditions. The excess heat in pump 25 may transfer to motor lead 33 because motor lead 33 lies alongside pump assembly 15 and in the prior art is in contact with the outer housing 51 of pump 25. The excess heat is particularly a problem with motor leads 33 having lead sheaths 45. Excess heat causes the lead sheaths 45 to soften and change shape, becoming thinner. If too thin, lead sheaths 45 may not be able to provide the desired protection to conductor insulation layers 43.

Figure 2:
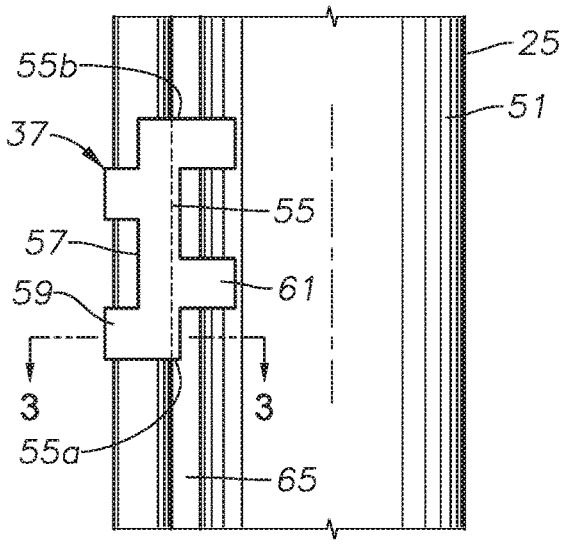
FIG. 2 is a enlarged side view of one of the standoffs of the pump assembly of FIG. 1.
Figure 4:
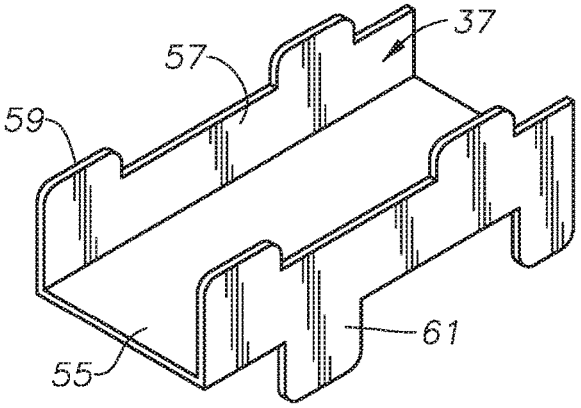
FIG. 4 is an isometric view of one of the standoffs removed from the pump assembly.

Referring also to FIGS. 2 and 4, each standoff 37 comprises a rigid channel or cradle 53 to reduce heat transfer to insulated conductors 39 by providing a space between motor lead 33 and pump housing 51 for well fluid to flow. Standoff 37 has a base 55 that may be flat, as shown or curved to match the cylindrical curvature of pump housing 51. Base 55 has a width slightly greater than the width of motor lead 33. Base 55 may be solid, free of apertures, as shown, or it may have openings. Base 55 has a lower end 55*a* and an upper end 55*b* axially spaced apart from each other.

Side walls 57 extend outward from opposite side edge of base 55. Side walls 57 extend from base lower end 55*a* to base upper end 55*b*. Side walls 57 may be flat and orthogonal with base 55 as shown or curved to match the curvature of curved sides 49*c* of armor 49. Motor lead 33 fits closely within side walls 57 with armor sides 49*c* in proximity or touching side walls 57. Armor inward-facing side 49*a* is in flush contact with base 55.

One or more lugs 59 extend radially outward from the outer edges of each side wall 57. In this example, each standoff has two lugs 59 protruding from each side wall 57, one above the other. The radial distance from base 55 to the outer edge of each lug 59 is greater than the thickness of motor lead 33, measured from outer armor inward-facing side 49*a* to outer armor outward-facing side 49*b*. Lugs 59 protrude past outer armor outward-facing side 49*b* to prevent contact of motor lead 33 with casing 13 (FIG. 1) while pump assembly 15 is being run into the well. The outer edge of each lug 59 may be curved or beveled, as shown in FIG. 4, or flat. In this example, one of the lugs 59 of each side wall 57 is at base lower end 55*a*. The other lug 59 is illustrated spaced downward from base upper end 55*b* by approximately the axial width of each lug 59. That positioning can vary.

Standoff 37 has at least one leg 61 that extends inward from base 55 into contact with pump housing 51. In this example, there are four legs 61, each extending inward from base 55. Two of the legs 61 are in the same plane as one of the side walls 57, and the other two are in the same plane as the other side wall 57. The upper two legs 61 are at base upper end 55*b* and the lower two legs 61 are spaced above base lower end 55*a* by about the width of each leg 61. The upper two legs 61 are thus above the upper two lugs 59, and the lower two legs 61 are also above the lower two lugs 59.

The number and positioning of lugs 59 and legs 61 can vary. The inward-facing edges of legs 61 may optionally be beveled to match the curvature of pump housing 51.

This arrangement allows standoffs 37 to be fabricated by stamping and bending from a single piece of sheet metal. However, standoffs 37 can be otherwise formed, such as by casting, molding, machining from bar stock, or 3D printing. Standoffs 37 could have other features to add strength and possibly enhanced cooling. For example, standoffs 37 could have a rippling of the surface to act like cooling fins to minimize motor lead 33 temperature. Each standoff 37 may be formed of a variety of materials, including those that are good thermal insulators.

As shown in FIG. 1, a standoff band 63 may optionally be employed to strap one or more of the standoffs 37 to pump 25. For example, standoff bands 63 are illustrated to secure the uppermost and lowermost standoffs 37 but not the middle standoff 37, which may be held in place solely by compressive wedging between motor lead 33 and pump 15. Standoff bands 63 may be the same as production tubing bands 31 and are crimped in tension around the desired standoffs 37. Each standoff band 63 will be in contact with the outer edges of side walls 57 (FIGS. 2 and 4) between lugs 59.

While pump assembly 15 is being prepared to be lowered into the well, workers will insert standoffs 37 between motor lead 33 and pump housing 51 at desired locations. Motor lead 33 is quite stiff, and pulling motor lead 33 away from pump housing 51 creates a radial inward bias force that wedges standoffs 37 in place. The compressive force on the rigid standoffs 37 retains standoffs 37 between motor lead 33 and pump housing 51. Standoff legs 61 need not be fastened to pump housing 51 by fasteners or adhesive. If desired, one or more standoff bands 63 may be used to strap some or all of the standoffs 37 in place.

Once standoffs 37 are secured, a flow channel 65 (FIG. 2) will exist between the inward-facing side of motor lead 33 and the exterior of pump housing 51. Also, a gap 67 (FIG. 3) will exist between base 55 of each standoff 37 and the outer surface of pump housing 51. If base 55 is flat as shown, gap 67 will have a minimum dimension at the center of base 55 between side walls 57 (FIG. 4). The minimum dimension of gap 67 may vary and may be as small as 1/16 inch. Gaps 67 and flow channels 65 facilitate the flow of well fluid between pump housing 51 and motor lead 33 to prevent excess heating of motor lead 33.

While the disclosure has been shown in only one of its forms, it should be apparent to those skilled in the art that it is susceptible to various changes.

The invention claimed is:

1. An electrical submersible pump assembly for pumping well fluid from a well, comprising:

a pump having a tubular pump housing with a longitudinal axis;

a motor operatively connected to the pump for driving the pump;

a motor lead extending alongside the pump housing to the motor for supplying electrical power to the motor;

at least one standoff between the pump housing and the motor lead, the at least one standoff having a channel in which the motor lead is received, a base, and axially spaced apart lugs extending outward from the channel relative to the axis; and the at least one standoff having side walls and axially spaced apart legs parallel with the side walls and extending inward from the channel relative to the axis into contact with the pump housing, the axially spaced apart legs spacing the channel of the at least one standoff away from the pump housing to define a gap between the channel and the pump housing that extends fully along a length and width of the channel, and that enables a flow of the well fluid between the motor lead and the pump housing, the axially spaced apart legs and lugs that are on a same side edge of each base are coplanar with one another.

2. The assembly according to claim 1, wherein the at least one standoff comprises an upper standoff, an intermediate standoff and a lower standoff spaced axially apart from each other.

3. The assembly according to claim 1, wherein the channel of the at least one standoff comprises:

a pair of side walls that each extend outward relative to the axis from an opposite edge of the base; and wherein at least one leg of the axially spaced apart legs extends inward from the base relative to the axis.

4. The assembly according to claim 1, further comprising:

a metallic band secured around the pump housing and over the channel of the at least one standoff, retaining the motor lead within the channel of the standoff.

5. The assembly according to claim 1, wherein the motor lead biases at least one leg of the axially spaced apart legs against the pump housing.

6. The assembly according to claim 1, wherein the at least one standoff comprises:

a pair of side walls that each extend outward relative to the axis from an opposite edge of the base, defining the channel, each sidewall of the pair of side walls having an outer edge spaced outward from the base relative to the axis;

wherein the axially spaced apart lugs extend outward from the outer edge of the pair of side walls; and wherein the axially spaced apart legs extend inward from the opposite side edges of the base.

7. The assembly according to claim 1, wherein the channel of the at least one standoff comprises:

a pair of side walls that each extend outward relative to the axis from an opposite edge of the base, each sidewall of the pair of side walls having an outer edge spaced outward from the base relative to the axis; and wherein the axially spaced apart lugs extend outward from the outer edge of the pair of side walls.

8. The assembly according to claim 7, wherein at least one leg of the axially spaced apart legs extends inward from the base relative to the axis.

9. An electrical submersible pump assembly for pumping well fluid from a well, comprising:

a pump having a tubular pump housing with a longitudinal axis;

a motor operatively connected to the pump for driving the pump;

a motor lead extending alongside the pump housing to the motor for supplying electrical power to the motor;

a plurality of standoffs for forming a gap between the motor lead and the pump housing in which the well fluid flows and cools the motor lead, each of the plurality of standoffs comprising:

a base;

legs extending inward from the base relative to the axis into abutment with an outer surface of the pump housing;

sidewalls extending outward, relative to the axis, from opposite side edges of the base, the sidewalls defining an outward-facing channel in which the motor lead locates;

lugs extending outward from the base relative to the axis, and wherein the legs and the lugs on a same lateral side of the base are axially offset from one another so that one of the legs is disposed at a location along a length of the base that is between the lugs, and wherein the legs have lengths selected to provide a flow passage between the motor lead and the outer surface of the pump housing to facilitate the flow of the well fluid.

10. The assembly according to claim 9, wherein the base is located in a single plane.

11. The assembly according to claim 9, wherein: the motor lead biases the legs of at least one of the plurality of standoffs against the pump housing.

12. The assembly according to claim 9, wherein: no portion of the base is in contact with the outer surface of the pump housing.

13. The assembly according to claim 9, further comprising: a metallic band secured around the pump housing and over the channel of at least one of the plurality of standoffs, retaining the motor lead within the channel of the at least one of the plurality of standoffs.

14. The assembly according to claim 13, wherein each of the plurality of the standoffs has the lugs extending outward from an outer edge of each of the sidewalls, and wherein the band extends between the pair of the lugs of the at least one of the plurality of standoffs.

15. An electrical submersible pump assembly, comprising:

a pump having a tubular pump housing with a longitudinal axis;

a motor for driving the pump;

a pressure equalizer connected between the motor and the pump for reducing a pressure differential between lubricant in the motor and well fluid exterior of the pump;

a motor lead extending into a well alongside the pump housing to the motor for supplying electrical power to the motor;

an upper standoff adjacent an upper end of the pump housing, a lower standoff adjacent a lower end of the pump housing and an intermediate standoff axially between the upper and lower standoffs, each of the upper, lower, and intermediate standoffs comprising:

a base having opposite side edges;

a plurality of legs, each extending radially inward from one of the opposite side edges of the base into abutment with the pump housing;

a pair of sidewalls, each extending radially outward from one of the opposite side edges of the base, defining an outward-facing channel in which the motor lead extends;

pairs of lugs, wherein the lugs of each pair of the pairs of lugs extend radially outward from the pair of sidewalls and being axially spaced apart from one another;

wherein an upper band extends around the pump housing and over the pair of sidewalls of the upper standoff and between the axially spaced apart pair of lugs of the upper standoff, retaining the motor lead in the channel of the upper standoff and retaining the upper standoff with the pump housing;

wherein a lower band extends around the pump housing and over the pair of sidewalls of the lower standoff and between the axially spaced apart pairs of lugs of the lower standoff, retaining the motor lead in the channel of the lower standoff; and wherein the plurality of legs have a length that provides a gap between the base of each of the upper, lower, and intermediate standoffs and the pump housing and a flow passage between the motor lead and the outer surface of the pump housing to facilitate a flow of the well fluid between the motor lead and the pump housing.

16. The assembly according to claim 15, wherein: the base of each of the upper, lower, and intermediate standoffs has an upper end and a lower end; and each sidewall of the pair of sidewalls extends from the upper end of the base to the lower end of the base, wherein the pairs of lugs protrude past the motor lead to prevent contact of the motor lead with casing in the well while the pump assembly is being run into the well.

17. The assembly according to claim 15, wherein the base of each of the upper, lower, and intermediate standoffs is flat.

18. The assembly according to claim 15, wherein the motor lead biases the plurality of legs of the intermediate standoff against the pump housing.

19. The assembly according to claim 18, wherein: each of the upper, lower, and intermediate standoffs has a first end and a second end; and the plurality of legs are closer to the first end than the axially spaced apart pairs of lugs.

* * * * *